US010943441B1

(12) United States Patent
Watson, III et al.

(10) Patent No.: US 10,943,441 B1
(45) Date of Patent: Mar. 9, 2021

(54) IMAGE PROCESSING SYSTEM AND METHOD FOR DETECTING ERRORS IN AN ATM TERMINAL

(71) Applicant: Bank of America Corporation, Charlotte, NC (US)

(72) Inventors: Verlon Safold Watson, III, Charlotte, NC (US); Shawn Cart Gunsolley, Charlotte, NC (US); Douglas S. Wilson, Nashua, NH (US)

(73) Assignee: Bank of America Corporation, Charlotte, NC (US)

( * ) Notice: Subject to any disclaimer, the term of this patent is extended or adjusted under 35 U.S.C. 154(b) by 0 days.

(21) Appl. No.: 16/894,669

(22) Filed: Jun. 5, 2020

(51) Int. Cl.

| | |
|---|---|
| ***G07F 19/00*** | (2006.01) |
| ***G07D 11/30*** | (2019.01) |
| ***G07D 11/165*** | (2019.01) |
| ***G07D 11/235*** | (2019.01) |

(52) U.S. Cl.
CPC ..... *G07F 19/203* (2013.01); *G07D 11/165* (2019.01); *G07D 11/235* (2019.01); *G07D 11/30* (2019.01); *G07F 19/207* (2013.01); *G07F 19/209* (2013.01)

(58) Field of Classification Search
CPC .... G07F 19/203; G07F 19/207; G07F 19/209; G07D 11/30; G07D 11/165; G07D 11/235
See application file for complete search history.

(56) References Cited

U.S. PATENT DOCUMENTS

| | | | |
|---|---|---|---|
| 2,950,799 | A | 8/1960 | Timms |
| 2,967,452 | A | 1/1961 | Patzer |
| 3,090,485 | A | 5/1963 | Moore |
| 3,122,227 | A | 2/1964 | Bookout et al. |
| 3,256,968 | A | 6/1966 | Riddle et al. |
| 3,340,978 | A | 9/1967 | Haville |
| 4,253,016 | A | 2/1981 | Hirose |
| 4,442,541 | A | 4/1984 | Finkel et al. |
| 5,014,325 | A | 5/1991 | Moritomo |
| 5,199,543 | A | 4/1993 | Kamagami et al. |

(Continued)

FOREIGN PATENT DOCUMENTS

| | | |
|---|---|---|
| CA | 2 304 281 A1 | 2/2000 |
| GB | 2 244 838 A | 12/1991 |

(Continued)

*Primary Examiner* — Laura A Gudorf
(74) *Attorney, Agent, or Firm* — Michael A. Springs

(57) ABSTRACT

A system is configured for detecting errors in an ATM. The system includes a processor that receives a withdrawal request from a user to receive cash from a cash dispenser of the ATM. Currency denominations and a number of bills for each currency denomination needed to fulfill the withdrawal request is determined. The expected cash to be dispensed from the ATM is a sum of multiplications of each currency denomination with its number of bills. The system sends signal commands to cassettes of the ATM to dispense bills to fulfill the withdrawal request. A camera is positioned in a pathway of the bills being dispensed from the cassettes to the cash dispenser. The camera captures images of bills being dispensed from the cassettes and sends them to the processor. The processor generates an alert if the actual dispensed cash from the cassettes does not match the expected cash.

20 Claims, 3 Drawing Sheets

(56) References Cited

U.S. PATENT DOCUMENTS

| | | | |
|---|---|---|---|
| 5,216,502 | A | 6/1993 | Katz |
| 5,253,167 | A | 10/1993 | Yoshida et al. |
| 5,260,582 | A | 11/1993 | Danek et al. |
| 5,563,393 | A | 10/1996 | Coutts |
| 5,607,040 | A | 3/1997 | Mathurin, Sr. |
| 5,666,157 | A | 9/1997 | Aviv |
| 6,131,718 | A | 10/2000 | Witschorik |
| 6,550,671 | B1 | 4/2003 | Brown et al. |
| 7,093,750 | B1 | 8/2006 | Block et al. |
| 7,230,223 | B2 | 6/2007 | Jespersen et al. |
| 7,595,816 | B1 | 9/2009 | Enright et al. |
| 7,724,938 | B2 | 5/2010 | Pareskevakos |
| 7,748,615 | B2 | 7/2010 | VanKirk et al. |
| 7,801,330 | B2 | 9/2010 | Zhang et al. |
| 7,984,847 | B1 | 7/2011 | Knouff et al. |
| 8,078,518 | B2 | 12/2011 | Goertz et al. |
| 8,210,426 | B1 | 7/2012 | Steinbach et al. |
| 8,630,950 | B2 | 1/2014 | Saegert et al. |
| 8,944,317 | B2 | 2/2015 | Lewis et al. |
| 9,911,104 | B2 | 3/2018 | Magee et al. |
| 10,176,466 | B2 | 1/2019 | Block et al. |
| 10,290,052 | B1 | 5/2019 | Quesenberry et al. |
| 10,353,689 | B2 | 7/2019 | Mishra et al. |
| 10,395,199 | B1 | 8/2019 | Gibson et al. |
| 2004/0024709 | A1 | 2/2004 | Yu et al. |
| 2004/0141059 | A1 | 7/2004 | Enright et al. |
| 2004/0215566 | A1 | 10/2004 | Meurer |
| 2007/0131757 | A1 | 6/2007 | Hamilton et al. |
| 2010/0042541 | A1 | 2/2010 | Kang et al. |
| 2015/0076223 | A1* | 3/2015 | Graef ..... G07F 19/202 235/379 |
| 2015/0363755 | A1 | 12/2015 | Walden et al. |
| 2015/0379489 | A1 | 12/2015 | Gopalakrishnan et al. |
| 2017/0221295 | A1 | 8/2017 | Pont et al. |
| 2019/0304232 | A1* | 10/2019 | Nicol ..... G07F 19/203 |
| 2020/0342704 | A1* | 10/2020 | Pechinko ..... G07D 7/12 |

FOREIGN PATENT DOCUMENTS

| | | | |
|---|---|---|---|
| JP | 2015-21152 | B * | 3/2015 |
| KR | 20 0357713 | Y1 | 7/2004 |
| KR | 101002722 | A | 7/2007 |
| KR | 100883558 | A | 3/2008 |
| KR | 101016217 | A | 8/2010 |

* cited by examiner

IMAGE PROCESSING SYSTEM AND METHOD FOR DETECTING ERRORS IN AN ATM TERMINAL

TECHNICAL FIELD

The present disclosure relates generally to image processing systems, and more specifically to an image processing system and method for detecting errors in an ATM terminal.

BACKGROUND

Typically, automatic teller machines (ATMs) include a set of cassettes to hold currency denominations. When a user requests to withdraw cash from an ATM terminal, a processor of the ATM terminal calculates an expected cash to be withdrawn from the cassettes to fulfill the user's request. The existing ATM terminals, however, do not have a mechanism to detect whether the actual dispensed cash from the cassettes matches the expected cash dispensed from the cassettes of the ATM terminal. Discrepancies between the actual dispensed cash and the expected dispensed cash may occur if, for example, a cassette is loaded with inconsistent currency denominations and/or a cassette is placed in the wrong place inside the ATM terminal.

SUMMARY

In one embodiment, an automated teller machine (ATM) includes a plurality of cassettes. Each cassette is configured to be loaded with a specific currency denomination, such that a first cassette is associated with a first currency denomination and a second cassette is associated with a second currency denomination. The ATM also includes a processor configured to receive a withdrawal request from a user operating a user interface of the ATM to receive cash from a cash dispenser of the ATM. The processor determines currency denominations and a number of bills for each currency denomination needed to fulfill the withdrawal request. The expected cash to be dispensed from the ATM is a sum of multiplications of each currency denomination with its number of bills. The processor sends signal commands to the plurality of cassettes to dispense bills based on the determined currency denominations and the number of bills for each currency denomination to fulfill the withdrawal request. The ATM also includes a camera positioned in a pathway of the bills being dispensed from the plurality of cassettes to the cash dispenser. The camera is configured to capture images of bills being dispensed from the plurality of cassettes and send the images of the bills to the processor. The processor is further configured to determine the actual dispensed cash from the plurality of cassettes based on received images from the camera, and whether the actual dispensed cash matches the expected cash to be dispensed from the ATM. The processor generates an alert if the actual dispensed cash does not match the expected cash.

In another embodiment, an ATM includes a plurality of cassettes. Each cassette is configured to be loaded with a specific currency denomination, such that a first cassette is associated with a first currency denomination and a second cassette is associated with a second currency denomination. The ATM also includes a processor configured to receive a withdrawal request from a user operating a user interface of the ATM to receive cash from a cash dispenser of the ATM. The processor determines a first expected number of bills from the first cassette and a second expected number of bills from the second cassette. The expected cash to be dispensed from the ATM to fulfill the withdrawal request is a sum of the first expected number of bills from the first cassette multiplied by the first currency denomination and the second expected number of bills from the second cassette multiplied by the second currency denomination. The processor sends signal commands to the first cassette and the second cassette to dispense the first expected number of bills and the second expected number of bills, respectively. The ATM also includes a camera positioned in a pathway of the bills being dispensed from the plurality of cassettes to the cash dispenser. The camera is configured to capture images of bills being dispensed from the first cassette and the second cassette, and send the images of the bills to the processor. The processor determines a first actual number of bills dispensed from the first cassette and a second actual number of bills dispensed from the second cassette, and whether the first actual number of bills matches the first expected number of bills. The processor generates an alert if the first actual number of bills does not match the first expected number of bills. The processor determines whether the second actual number of bills matches the second expected number of bills. The processor generates an alert if the second actual number of bills does not match the second expected number of bills.

Existing automated dispensing devices, such as ATM terminals, lack capabilities to detect errors in the internal dispensing side of the dispensing devices. For example, the existing ATM terminals do not have a mechanism to determine whether an expected amount of cash requested by a user matches an actual amount of cash dispensed from the cassettes of the ATM terminal. In another example, the existing ATM terminals do not have a mechanism to determine whether, for each cassette, an expected number of bills from a cassette matches an actual number of bills dispensed from the cassette. Certain embodiments of this disclosure provide unique solutions to technical problems of the dispensing devices, e.g., ATM terminals, to detect errors in the internal dispensing side of the dispensing devices. For example, the disclosed system provides several technical advantages which include: 1) determining whether an actual amount of cash dispensed from the cassettes of the ATM terminal matches an expected amount of cash requested by a user; 2) determining whether, for each cassette of the ATM terminal, an actual number of bills dispensed from a cassette matches an expected number of bills from the cassette; and 3) preventing to dispense a wrong amount and/or denomination of cash to users. As such, this disclosure may improve the function of the ATM terminals technology by reducing errors in the dispensing side of the ATM terminals and consequently increasing the accuracy of ATM terminals' operation.

Accordingly, the system described herein provides a practical application of managing the dispensing side of the ATM terminals. This, in turn, provides the additional practical application of improving the accuracy of the ATM terminals' operation which consequently improves the underlying computer of the ATM terminals.

Certain embodiments of this disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
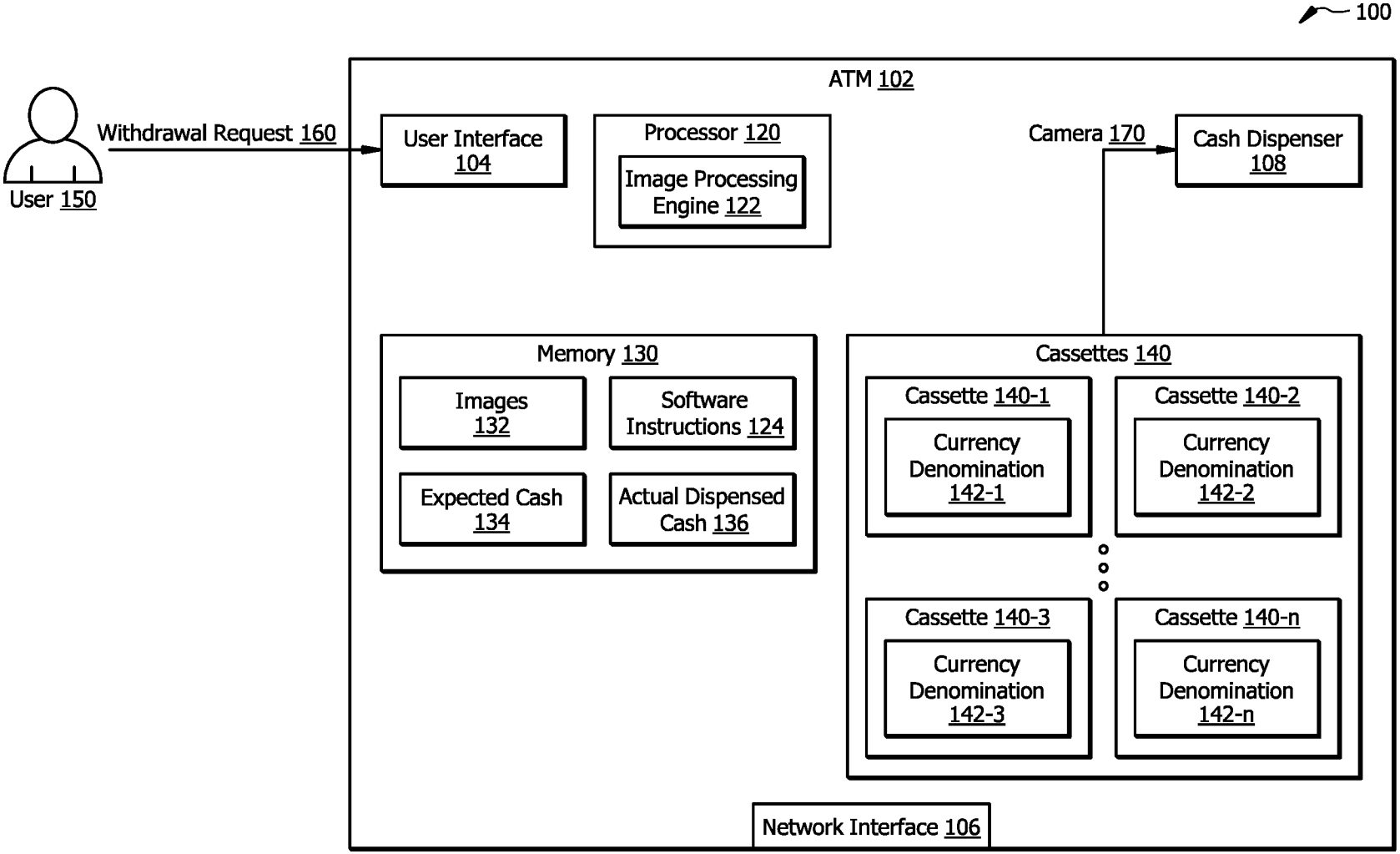
FIG. 1 illustrates one embodiment of a system configured to detect errors in an ATM terminal.

FIG. 1 illustrates one embodiment of a system 100 configured to detect errors in a dispensing side of an ATM terminal 102. In one embodiment, the system 100 comprises the ATM terminal 102 which includes processor 120 in signal communication with a network interface 106 and a memory 130. Memory 130 includes software instructions 124 that when executed by the processor 120 cause the ATM terminal 102 to perform one or more functions described herein. Memory 130 may also include one or more images 132 that provide information that may be used by software instructions 124 and/or processor 120. In one embodiment, the processor 120 includes an image processing engine 122. In other embodiments, system 100 may not have all of the components listed and/or may have other elements instead of, or in addition to, those listed above.

In general, the system 100 improves the operation of an ATM terminal 102 by detecting errors in the dispensing of cash from an ATM terminal 102 in response to a withdrawal request. The system 100 can help prevent the wrong amount or denominations of cash being dispensed to users. Therefore, the system 100 improves the operation of the ATM terminal 102.

ATM terminal 102 is generally any automated dispensing device configured to dispense items when users interact with the dispensing device. For example, the ATM terminal 102 may include or be provided with a terminal device for dispensing cash, tickets, scrip, travelers' checks, airline tickets, gaming materials, other items of value, etc. In a particular embodiment, ATM terminal 102 is an automated teller machine that allows users to withdraw cash, check balances, and/or make deposits interactively using, for example, a magnetically encoded card, to perform transactions.

Typically, the ATM terminal 102 includes cassettes 140 to hold different currency denominations 142. Some vendors of the ATM terminals 102 may produce an ATM terminal 102 that has dedicated places for different cassettes 140. Some vendors of the ATM terminals 102 may produce an ATM terminal 102 in which the cassettes 140 can be placed interchangeably in different places. Each of the cassettes 140 is associated with a specific currency denomination 142. For example, a first cassette 140-1 is associated with a first currency denomination 142-1, e.g., 10 USD; a second cassette 140-2 is associated with a second currency denomination 142-2, e.g., 20 USD; and an n-th cassette **140-*n* is associated with an n-th currency denomination 142-*n*. The ATM terminal 102 includes one or more cameras 170 positioned in a pathway of the bills being dispensed from the cassettes 140 to the cash dispenser 108 to capture images 132 of the bills being dispensed from the cassettes 140. The cameras 170 are configured to send the images 132 of the bills being dispensed from the cassettes 140 to the image processing engine 122. The image processing engine 122 determines whether the actual dispensed cash 136 from the cassettes 140 matches the expected cash 134 which was requested by the user 150. Details of the operation of determining the actual dispensed cash 136 is described in conjunction with the image processing engine 122 in FIG. 1 and the operational flow illustrated in FIG. 2. In general, the ATM terminal 102 receives a withdrawal request 160 from a user 150 to dispense cash from a cash dispenser 108. Processor 120 determines the currency denominations 142 and a number of bills for each currency denomination 142 needed to fulfill the withdrawal request 160. The processor 120 then activates the cassettes 140 to dispense bills based on the determined currency denominations 142 and their number of bills. The image processing engine 122 may detect one or more errors using the image 132 of the bills being dispensed from the cassettes 140 captured by the cameras 170. In some examples, the one or more errors may include a cassette 140 that is loaded with a currency denomination 142 that is not associated with the cassette 140, a cassette 140 is misplaced in a slot dedicated to another cassette 140, for each cassette 140, an expected number of bills does not match the actual number of bills dispensed from the cassette 140, etc. Examples of the one or more errors mentioned above are described in more detail in conjunction with the operation of the image processing engine 122. The image processing engine 122 may detect the one or more errors mentioned above by comparing the actual dispensed cash 136 (using the images 132) with the expected cash 134 requested from the user 150 and determine whether the actual dispensed cash 136 matches the expected cash 134. If the image processing engine 122 detects one or more errors mentioned above, the image processing engine 122 generates an alert indicating that one or more cassettes 140** are faulty.

Processor 120 comprises one or more processors operably coupled to the user interface 104, network interface 106, cash dispenser 108, memory 130, and cassettes 140. The processor 120 is any electronic circuitry including, but not limited to, state machines, one or more central processing unit (CPU) chips, logic units, cores (e.g. a multi-core processor), field-programmable gate array (FPGAs), application-specific integrated circuits (ASICs), or digital signal processors (DSPs). The processor 120 may be a programmable logic device, a microcontroller, a microprocessor, or any suitable combination of the preceding. The one or more processors are configured to process data and may be implemented in hardware or software. For example, the processor 120 may be 8-bit, 16-bit, 32-bit, 64-bit, or of any other suitable architecture. The processor 120 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The one or more processors are configured to implement various instructions (e.g., software instructions 124). For example, the one or more processors are configured to execute instructions to implement image processing engine 122. In this way, processor 120 may be a special purpose computer designed to implement the functions disclosed herein. In an embodiment, the processor 120 is implemented using logic units, FPGAs, ASICs, DSPs, or any other suitable hardware. The image processing engine 122 is configured to operate as described in FIGS. 1-3. For example, image processing engine 122 may be configured to perform the steps of method 300 as described in FIG. 2.

Network interface 106 is configured to enable wired and/or wireless communications (e.g., to other computing devices). The network interface 106 is configured to communicate data between the ATM terminal 102 and other devices, systems, or domain(s). For example, the network interface 106 may comprise a WIFI interface, a local area network (LAN) interface, a wide area network (WAN) interface, a modem, a switch, or a router. The processor 120 is configured to send and receive data using the network interface 106. The network interface 106 may be configured to use any suitable type of communication protocol as would be appreciated by one of ordinary skill in the art.

Memory 130 may be volatile or non-volatile and may comprise read-only memory (ROM), random-access memory (RAM), ternary content-addressable memory (TCAM), dynamic random-access memory (DRAM), and static random-access memory (SRAM). Memory 130 may be implemented using one or more disks, tape drives, solid state drives, or the like. Memory 130 stores images 132, expected cash 134, actual dispensed cash 136, software instructions 124, and/or any other data or instructions. The software instructions 124 may comprise any suitable set of instructions, logic, rules, or code operable to perform the functions of the image processing engine 122 when executed by processor 120. The stored images 132, expected cash 134, actual dispensed cash 136, and software instructions 124 are described in more detail below.

Image Processing Engine

Image processing engine 122 may be implemented using software instructions 124 executed by the processor 120, and is configured to detect errors in the dispensing side of the ATM terminal 102. In some cases, an error in the dispensing side of the ATM terminal 102 may be a case where the actual dispensed cash 136 does not match the expected cash 134 (e.g., requested from a user 150). In such cases, one or more errors such as where a cassette 140 is loaded with a currency denomination 142 not associated with the cassette 140 and/or a cassette 140 is misplaced in a slot not dedicated for the cassette 140 may have led to discrepancies between the actual dispensed cash 136 and the expected cash 134.

For example, consider a case where the user 150 requests to withdraw 110 USD. The processor 120 may send a first signal command to a first cassette 140-1 associated with a 10 USD denomination 142-1 to dispense one 10 USD bill. The processor 120 may also send a second signal command to a second cassette 140-2 associated with a 20 USD denomination 142-2 to dispense five 20 USD bills. For this particular example, assume that (due to an error) the first cassette 140-1 is loaded with a currency denomination 142 not associated with the first cassette 140-1, such as 20 USD denomination 142-2, and dispenses one 20 USD bill instead of one 10 USD bill. Also assume that the second cassette 140-2 is correctly loaded with 20 USD bills, and dispenses five 20 USD bills. Thus, the actual dispensed cash 136 is 120 USD which does not match the expected cash 134 of 110 USD requested by the user 150.

In another example for the case above, assume that the first cassette 140-1 is misplaced in a slot dedicated to the second cassette 140-2 and the second cassette 140-2 is misplaced in a slot dedicated to the first cassette 140-1. Thus, the first signal command which was meant for the first cassette 140-1 goes to the second cassette 140-2 and the second signal command which was meant for the second cassette 140-2 goes to the first cassette 140-1. Therefore, the first cassette 140-1 which was supposed to dispense one 10 USD bill, dispenses five 10 USD bills; and the second cassette 140-2 which was supposed to dispense five 20 USD bills, dispenses one 20 USD bill. This leads to the total actual dispensed cash 136 of 70 USD which does not match the expected cash 134 of 110 USD requested by the user 150. In some cases, an error in the dispensing side of the ATM terminal 102 may be a case where for at least one cassette 140, an expected number of bills being dispensed from the cassette 140 does not match an actual number of bills dispensed from the cassette 140. For example, consider a case where the user 150 requests to withdraw 110 USD. For this particular example, assume that the first cassette 140-1 dispenses three 10 USD bills; and that the second cassette 140-2 dispenses four 20 USD bills. Thus, the total actual dispensed cash 136 will be 110 USD which matches the expected cash 134. However, the first actual number of bills dispensed from the first cassette 140-1 (i.e., three 10 USD bills) does not match a first expected number of bills with 10 USD currency denomination 142-1 (one 10 USD bill). Also, the second actual number of bills dispensed from the second cassette 140-2 (i.e., four 20 USD bills) does not match a second expected number of bills with 20 USD currency denomination 142-1 (five 20 USD bills).

In one embodiment, the image processing engine 122 is configured to receive images 132 of bills being dispensed from the cassettes 140 from the camera 170. The image processing engine 122 determines a currency denomination 142 of each bill by comparing its specific characteristics to specific characteristics of bills with known denominations 142. The image processing engine 122 may use an image recognition algorithm that is previously trained using a training dataset to determine the currency denominations 142 of bills. This training dataset may include bills from different currency denominations 142 labeled with their currency denominations. In some examples, several characteristics of the bills are considered in the training dataset, such as a bar code, colors, sizes, graphics, texts, hologram signatures, and digits representing a denomination 142 of each bill on both sides. In some embodiments, the image processing engine 122 is configured to detect the denomination 142 of each bill even when they are not in a new condition. As such, the training dataset may include images of bills in different conditions, such as new, wrinkled, taped, written on, torn, etc. For example, TABLE 1 illustrates an exemplary training dataset of currency denominations 142 for two bills. TABLE 1 described here is illustrative only and is not meant to limit the scope of the invention or its embodiments.

TABLE 1

Example training dataset.

| Bill No. | Denomination 142 (USD) | Bill's text at a first location | Bill's text at a second location | Bill's bar code | Bill's digit at a third location s | Bill's condition |
|---|---|---|---|---|---|---|
| 1 | 10 | TEN DOLLARS | Hamilton | GL5887520348A | 10 | New |
| 2 | 10 | TEN DOLLARS | Hamilton | GL5546436758A | 10 | Wrinkled |

TABLE 1-continued

Example training dataset.

| Bill No. | Denomination 142 (USD) | Bill's text at a first location | Bill's text at a second location | Bill's bar code | Bill's digit at a third location s | Bill's condition |
|---|---|---|---|---|---|---|
| 3 | 10 | TEN DOLLARS | Hamilton | GL5464654658A | 10 | Written on |
| 4 | 20 | TWENTY DOLLARS | Jackson | ID85634646635B | 20 | Taped |
| 5 | 20 | TWENTY DOLLARS | Jackson | ID35465465835B | 20 | Torn |
| 6 | 20 | TWENTY DOLLARS | Jackson | ID64660907635B | 20 | New |

As illustrated in TABLE 1, images of three 10 USD bills and three 20 USD bills in different conditions are used to train the image processing engine 122. Once the image processing engine 122 is trained with the training dataset, the image processing engine 122 may be validated and tested to determine denominations 142 of bills in which images were not among the training dataset.

As discussed above, some ATM terminal 102 vendors produce cassettes 140 that may be placed interchangeably in different slots inside the ATM terminal 102. Thus, it is important to determine whether each cassette 140 is placed in the right slot.

Figure 2:
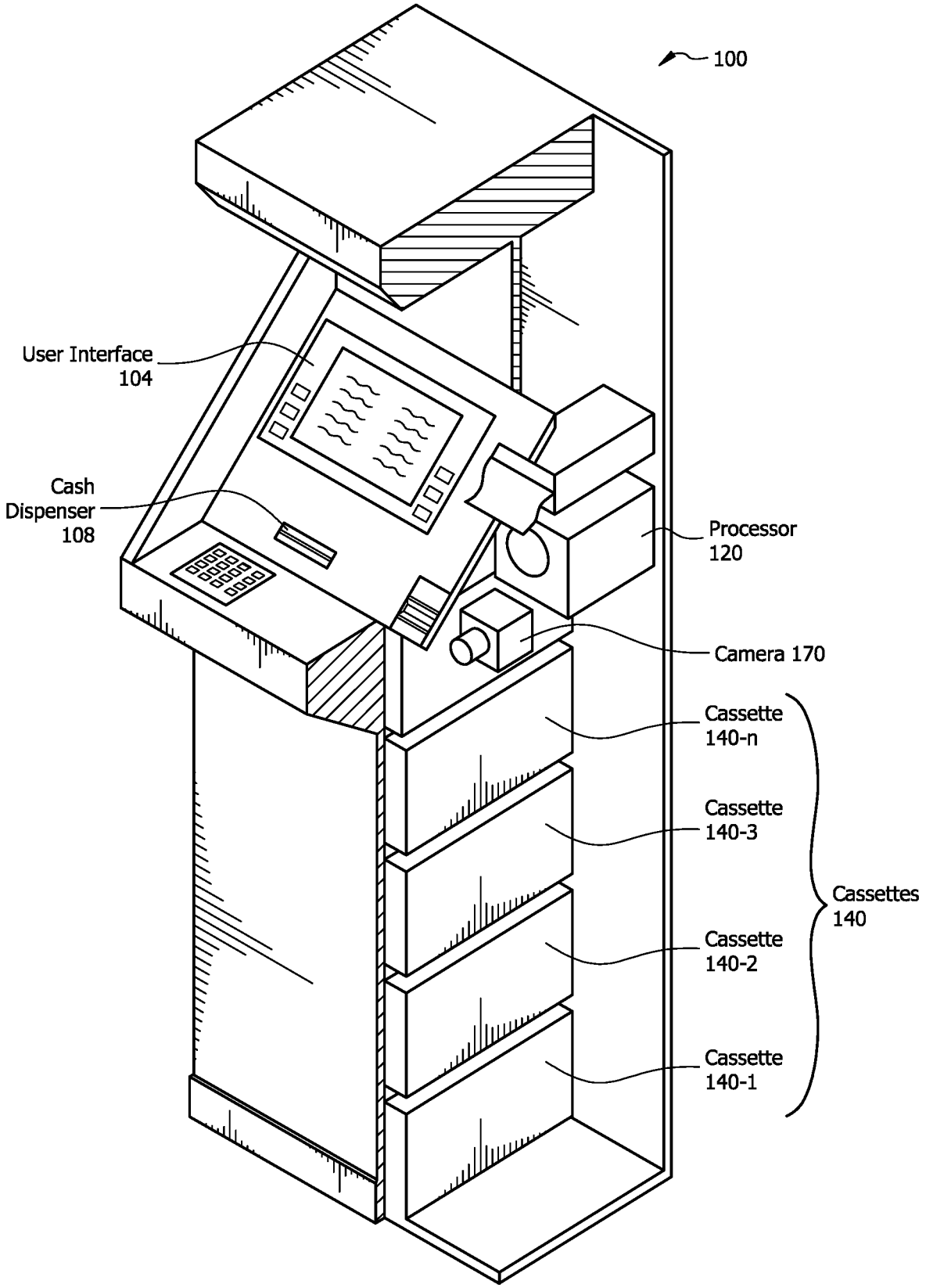
FIG. 2 illustrates an example of a cross-sectional view of an ATM terminal.

FIG. 2 illustrates a cross-sectional view of the ATM terminal 102. As shown in FIG. 2, the cassettes 140 are placed on top of each other and each cassette 140 has a dedicated place. For example, a first cassette 140-1 is placed first from the bottom; and a second cassette 140-2 is placed second from the bottom. The locations of the cassettes 140 are known to the processor 120 and stored in memory 130. For example, the processor 120 is programmed such that the first cassette 140-1 loaded with the first currency denomination 142-1, e.g., 10 USD is placed in a first location; and the second cassette 140-2 loaded with the second currency denomination 142-2, e.g., 20 USD is placed in a second location inside the ATM terminal. In the process of loading and/or changing the cassettes 140 by an employee of a vendor of the ATM terminal 102, a cassette 140 may be placed in a wrong slot. Thus, it is important to determine whether the cassettes 140 are placed in their dedicated slots.

When the processor 120 determines that a bill will be dispensed from a cassette 140, the camera 170 may also take images 132 of the cassette 140 and send them to the image processing engine 122. The image processing engine 122 may then determine whether the cassette 140 is placed in its dedicated slot by comparing the detected currency denomination 142 of cassette 140 (by the image processing engine 122) by the expected currency denomination 142 of cassette 140 known to the processor 120 based on its location (e.g., stored in memory 130). For example, consider a case where a 20-dollar cassette 140-2 is misplaced in a 10-dollar cassette 140-1. In this case, when a user 150 requests to withdraw 10 USD, a 20 USD is incorrectly dispensed from the 20-dollar cassette 140-2. The image processing engine 122 compares currency denomination of the 10 USD bill which was expected with the currency denomination 142 of the second cassette 140-2 (i.e., 20 USD) which was dispensed, and determines that the dispensed cash denomination (e.g., 20 USD) does not match the expected cash denomination (e.g., 10 USD), and thereby concludes that second cassette 140-2 is placed in a wrong slot and generates an alert indicating that the second cassette 140-2 is placed in a wrong slot.

In some embodiments, a cassette 140 may be loaded with a wrong currency denomination 142 (e.g., by an employee of a vendor of the ATM terminal 102). As such, it is important to determine whether each cassette 140 is loaded with its associated currency denomination 142. Thus, the image processing engine 122 may also be configured to determine whether a cassette 140 is loaded with its expected currency denomination 142 by comparing the dispensed currency denomination from the cassette 140 and the expected currency denomination 142 of the cassette 140. For example, consider a case where a 20-dollar cassette 140-2 is loaded with one or more 10 USD bills (assuming that the image processing engine 122 has already determined that the 20-dollar cassette 140-2 is placed in its correct slot). In this case, when a user 150 requests to withdraw 20 USD, a 10 USD may be incorrectly dispensed from the 20-dollar cassette 140-2. In this case, image processing engine 122 compares the currency denomination of the dispensed cash (e.g., 10 USD) with the expected cash denomination of the 20-dollar cassette 140-2 (e.g., 20 USD), determines that they don't match and concludes that the 20-dollar cassette 140-2 is loaded with at least one 10 USD bill. Image processing engine 122 then generates an alert indicating that the 20-dollar cassette 140-2 includes at least some bills of a denomination that is not associated with the 20-dollar cassette 140-2.

Figure 3:
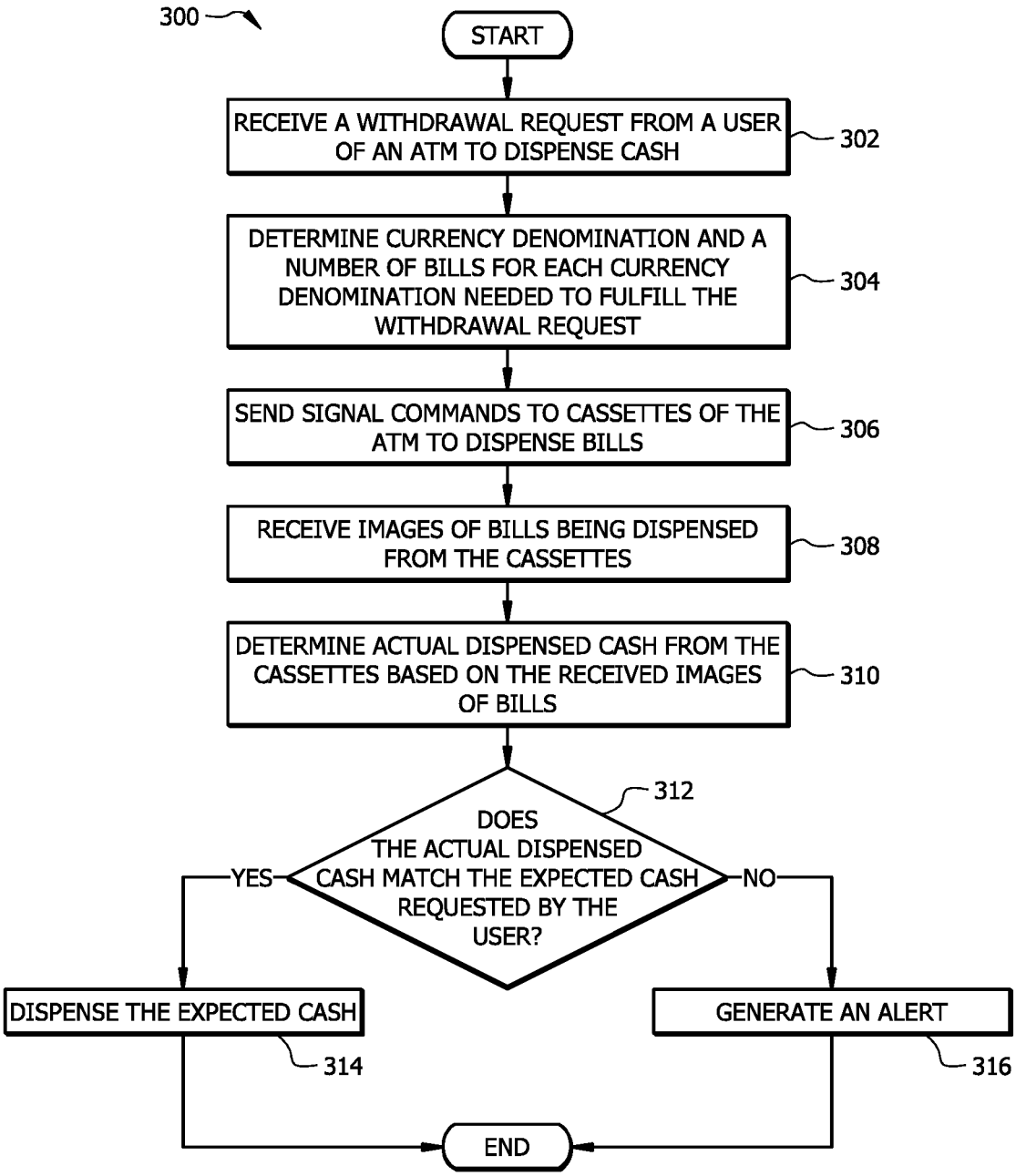
FIG. 3 illustrates an example of a flow chart of a method for detecting errors in an ATM terminal.

FIG. 3 illustrates a flow chart of a method 300 for detecting errors in dispensing cash from an ATM terminal 102. One or more of steps 302-316 of the method 300 may be implemented, at least in part, in the form of software instructions 124 stored on non-transitory, tangible, machine-readable media (e.g., memory 130) that when run by one or more processors (e.g., processor 120) may cause the one or more processors to perform steps 302-316. In some embodiments, method 300 may be performed on system 100 of FIG. 1, including ATM terminal 102, processor 120, image processing engine 122, and a camera 170. Aspects of the steps 302-316 of the method 300 have been covered in the description for FIG. 1; and additional aspects are provided below.

A First Example of a Method for Detecting Errors in an ATM Terminal

The method 300 begins at step 302 where the ATM terminal 102 receives a withdrawal request 160 from the user 150, such as via the user interface 104, to dispense cash from the cash dispenser 108. At step 304, processor 120 determines the currency denominations and a number of each denomination needed to fulfill the withdrawal request 160 in order to determine the expected cash 134 to be dispensed from the ATM terminal 102. The expected cash 134 is a sum of multiplications of each currency denomination with its number of bills. In one example, assuming that the user 150 has requested to withdraw 100 USD, the processor 120 determines that, based on available bills in the cassettes 140, five 20 USD bills are needed to be dispensed from the cassettes 140 to fulfill the user's request. In another example, assuming that the user 150 has requested to withdraw 110 USD, the processor 120 determines that, based on available bills in the cassettes 140, one 10 USD from the first cassette 140-1 (which is associated with 10 USD denomination) and five 20 USD bills from the second cassette 140-2 (which is associated with 20 USD denomination) are needed to be dispensed to fulfill the user's request.

At step 306, the processor 120 sends signal commands to the cassettes 140 to dispense the expected cash 134 based on the determined currency denominations and their number of bills to fulfill the withdrawal request 160. For example, assuming that the user 150 has requested to withdraw 110 USD from the ATM terminal 102, the processor 120 sends a first signal command to the first cassette 140-1 to dispense one 10 USD bill; and sends a second signal command to the second cassette 140-2 to dispense five 20 USD bills.

In step 308, the image processing engine 122 receives the images 132 of the bills being dispensed from the cassettes 140 captured by the camera 170. In some embodiments, the image processing engine 122 receives the images 132 in real-time when each bill is dispensed from its corresponding cassette 140. In some embodiments, a plurality of cameras 170 may be positioned in the pathway of the bills being dispensed from the cassettes 140 to the cash dispenser 108. For example, a first camera 170 may be positioned with respect to the first cassette 140-1 and capture images 132 of bills being dispensed from it; and a second camera 170 may be positioned with respect to the second cassette 140-2 and capture images 132 of bills being dispensed from it; and so on. In this example, each of the cameras 170 sends its captured images 132 to the processor 120.

In step 310, the image processing engine 122 determines the total actual dispensed cash 136 from the cassettes 140 based on the received images 132 by using an image recognition algorithm as described in FIG. 1. In a first example, consider a case where the user 150 requests to withdraw 110 USD; and one 10 USD bill from the first cassette 140-1 and five 20 USD bills from the second cassette 140-2 are dispensed. Then, the camera 170 captures the images 132 of these six bills and sends them to the image processing engine 122. In this particular example, the image processing engine 122 determines that the actual dispensed cash 136 from the cassettes 140 is 110 USD. In a second example, consider a case where the user 150 requests to withdraw 110 USD. For this particular example, assume that (due to an error) the first cassette 140-1 is loaded with a currency denominations 142 not associated with the first cassette 140-1, such as 20 USD denomination 142-2. Also, assume that the second cassette 140-2 is correctly loaded with 20 USD denomination 142-2. Thus, after receiving the signal commands from the processor 120, the first cassette 140-1 dispenses one 20 USD bill; and the second cassette dispenses five 20 USD bills. The camera 170 captures the images 132 of these six bills and sends them to the image processing engine 122. In this particular example, the image processing engine 122 determines that the actual dispensed cash 136 from the cassettes 140 is 120 USD. In a third example, consider a case where the user 150 requests to withdraw 110 USD. For this particular example, assume that (due to an error) the first cassette 140-1 is misplaced in a slot dedicated to the second cassette 140-2; and the second cassette 140-2 is misplaced in a slot dedicated to the first cassette 140-1. Also, assume that the first cassette 140-1 correctly is loaded with 10 USD denomination 142-1; and the second cassette 140-2 is correctly loaded with 20 USD denomination 142-2. Thus, a first signal command which was meant for the first cassette 140-1 to dispense one 10 USD bill goes to the second cassette 140-2; and a second signal command which was meant for the second cassette 140-2 to dispense five 20 USD bills goes to the first cassette 140-1. Therefore, the first cassette 140-1 dispenses five 10 USD bills; and the second cassette 140-2 dispenses one 20 USD bill. The camera 170 captures the images 132 of these six bills and sends them to the image processing engine 122. In this particular example, the image processing engine 122 determines that the actual dispensed cash 136 from the cassettes 140 is 70 USD.

In step 312, the image processing engine 122 determines whether the actual dispensed cash 136 from the cassettes 140 matches the expected cash 134 requested by the user 150 by using an image recognition algorithm as described in FIG. 1. If the actual dispensed cash 136 matches the expected cash 134, the method 300 proceeds to step 214, where the processor 120 dispenses the expected cash 134 to the user 150 from the cash dispenser 108. Continuing the first example described in step 310 where the actual dispensed cash 136 and the expected cash 134 are both 110 USD, the processor 120 dispenses 110 USD to the user 150 from the cash dispenser 108.

If, however, the actual dispensed cash 136 does not match the expected cash 134, the method 300 proceeds to the step 316 where, the processor 120 generates an alert followed by one or more actions, such as displaying a failed transaction message using the user interface 104 of the ATM terminal 102, initiating a service request to a vendor of the ATM terminal 102, or some other appropriate action. Continuing the second example described in step 310 where the actual dispensed cash 136 is 120 USD and the expected cash 134 is 110 USD, the processor 120 generates an alert indicating that the actual dispensed cash 136 is not equal to the expected cash 134. Similarly, continuing the third example described in step 310 where the actual dispensed cash 136 is 70 USD and the expected cash 134 is 110 USD, the processor 120 generates an alert indicating that the actual dispensed cash 136 is not equal to the expected cash 134.

A Second Example of a Method for Detecting Errors in an ATM Terminal

In some embodiments, the system 100 and method 300 may be configured to determine whether an actual number of bills dispensed from each cassette 140 matches an expected number of bills to be dispensed from each corresponding cassette 140.

As such, referring back to step 304, in some embodiments, the processor 120 may determine a different expected number of bills from different cassettes 140 to be dispensed to fulfill the withdrawal request 160. For example, the processor 120 may determine a first expected number of bills from the first cassette 140-1; and a second expected number of bills from the second cassette 140-2 to be dispensed to fulfill the withdrawal request 160. In this example, the expected cash 134 to be dispensed from the ATM terminal 102 to fulfill the withdrawal request 160 is a sum of the first expected number of bills from the first cassette 140-1 multiplied by the first currency denomination 142-1 and the second expected number of bills from the second cassette 140-2 multiplied by the second currency denomination 142-2. For example, assume that the user 150 has requested to withdraw 110 USD. In this particular example, the processor 120 determines that, based on available bills in the cassettes 140, the first expected number of bills from the first cassette 140-1 (which is associated with 10 USD denomination 142-1) is one; and the second expected number of bills from the second cassette 140-2 (which is associated with 20 USD denomination 142-2) is five. Thus, the processor 120 determines that one 10 USD bill and five 20 USD bills are needed to be dispensed to fulfill the user's request.

The camera 170 captures the images 132 of the actual dispensed bills and sends them to the image processing engine 122. The image processing engine 122 may then determine separate actual number of bills being dispensed from different cassettes 140 based on the received images 132. For example, the image processing engine 122 may determine a first actual number of bills being dispensed from the first cassette 140-1; and a second actual number of bills being dispensed from the second cassette 140-2. For example, assume that the user 150 has requested to withdraw 110 USD. Also assume that one 10 USD bill from the first cassette 140-1; and five 20 USD bills from the second cassette 140-2 are being dispensed, respectively. Thus, the image processing engine 122 determines the first actual number of 10 USD bills being dispensed from the first cassette 140-1 is one; and the second actual number of 20 USD bills being dispensed from the second cassette 140-2 is five. The image processing engine 122 may also determine whether the first actual number of bills matches the first expected number of bills; and whether the second actual number of bills matches the second expected number of bills. Thus, if the first actual number of bills does not match the first expected number of bills, the processor 120 generates an alert indicating that the first cassette 140-1 is faulty; and if the second actual number of bills does not match the second expected number of bills, the processor 120 generates an alert indicating that the second cassette 140-2 is faulty. For example, assume that the user 150 has requested to withdraw 110 USD. For this particular example, assume that (due to an error) the first cassette 140-1 is misplaced in a slot dedicated to the second cassette 140-2; and the second cassette 140-2 is misplaced in a slot dedicated to the first cassette 140-1. Also, assume that the first cassette 140-1 is correctly loaded with 10 USD denomination 142-1; and the second cassette 140-2 is correctly loaded with 20 USD denomination 142-2. Thus, the first signal command which was meant for the first cassette 140-1 to dispense one 10 USD bill (corresponding to the first expected number of bills) goes to the second cassette 140-2. The second signal command which was meant for the second cassette 140-2 to dispense five 20 USD bills (corresponding to the second expected number of bills) goes to the first cassette 140-1. Therefore, the first cassette 140-1 dispenses five 10 USD bills; and the second cassette dispenses one 20 USD bill. The camera 170 captures the images 132 of these six bills and sends it to the image processing engine 122. The image processing engine 122 determines that the first actual number of bills is five 10 USD bills from the first cassette 140-1; and the second actual number of bills is one 20 USD bill from the second cassette 140-2.

In this particular example, the image processing engine 122 determines that the first actual number of bills (i.e., five 10 USD bills) does not match the first expected number of bills (i.e., one 10 USD bill). The image processing engine 122 also determines that the second actual number of bills (i.e., one 20 USD bill) does not match the second expected number of bills (i.e., five 20 USD bills). Therefore, the image processing engine 122 generates an alert indicating that the first cassette 140-1 and the second cassette 140-2 are faulty.

In some embodiments, the processor 120 may determine the order of dispensing bills from different cassettes 140 and in that order determine whether any of the cassettes 140 is dispensing a currency denomination 142 not associated with its currency denomination 142 and/or whether a cassette 140 is misplaced with another cassette 140 as described in FIG. 1. For example, the processor 120 may determine that the first cassette 140-1 dispenses bills first and the second cassette 140-2 dispenses bills second. In this particular example, the camera 170 captures a first set of images 132 of the bills being dispensed from the first cassette 140-1 and sends those images 132 to the image processing engine 122. The image processing engine 122 may determine whether the currency denominations 142 of bills from the first cassette 140-1 matches the first currency denomination 142-1 and/or the first cassette 140-1 is misplaced with another cassette 140 by using the image recognition algorithm as described in FIG. 1. The processor 120 generates an alert if the currency denominations 142 of any of the bills from the first cassette 140-1 does not match the first currency denomination 142-1 and/or the first cassette 140-1 is misplaced with another cassette 140. The processor 120 may then flag the first cassette 140-1 as faulty indicating that the first cassette 140-1 is loaded with at least one a currency denomination 142 that is not the first currency denomination 142-1 and/or the first cassette 140-1 is misplaced with another cassette 140.

Then, the camera 170 captures a second set of images 132 of bills being dispensed from the second cassette 140-2 and sends those images 132 to the processor 120. The image processing engine 122 may determine whether the currency denominations 142 of bills from the second cassette 140-2 matches the second currency denomination 142-2 and/or the second cassette 140-2 is misplaced with another cassette 140 by using the image recognition algorithm as described in FIG. 1. The processor 120 generates an alert if the currency denominations of any of the bills from the second cassette 140-2 does not match the second currency denomination 142-2 and/or the second cassette 140-2 is misplaced with another cassette 140. The processor 120 may then flag the second cassette 140-2 as faulty indicating that the second cassette 140-2 is loaded with at least one currency denomination 142 that is not the second currency denomination 142-2 and/or the second cassette 140-2 is misplaced with another cassette 140.

For example, consider a case where the user 150 requests to withdraw 110 USD. For this particular example, assume that (due to an error) the first cassette 140-1 is loaded with a currency denominations 142 that is not associated with the first cassette 140-1, such as 20 USD denomination 142-2. Also, assume that the second cassette 140-2 is correctly loaded with 20 USD denominations 142-2. Thus, after receiving the signal commands from the processor 120, the first cassette 140-1 dispenses one 20 USD bill; and the second cassette 140-2 dispenses five 20 USD bills. The camera 170 captures the first set of images 132 of the one 20 USD bill being dispensed from the first cassette 140-1 and sends them to the image processing engine 122. The image processing engine 122 determines that the currency denomination 142 of the 20 USD dispensed from the first cassette 140-1 does not match the first currency denomination 142-1 associated with the first cassette 140-1 (i.e., 10 USD denomination 142-1) using the image recognition algorithm described in FIG. 1. Thus, the processor 120 generates an alert indicating that the first cassette 140-1 is loaded with at least one currency denomination 142 that is not the first currency denomination 142-1 and/or the first cassette 140-1 is misplaced with another cassette 140.

Then, the camera 170 captures the second set of images 132 of the five 20 USD bills and sends them to the image processing engine 122. The image processing engine 122 determines that the currency denomination 142 of the five 20 USD bills dispensed from the second cassette 140-2 matches the second currency denomination 142-2 associated with the second cassette 140-2 (i.e., 20 USD denomination 142-2) using the image recognition algorithm described in FIG. 1. Here, the processor 120 does not generate an alert regarding the second cassette 140-2. In another example, assume that the user 150 has requested to withdraw 110 USD. For this particular example, assume that the first cassette 140-1 is misplaced (due to an error) in a slot dedicated to a third cassette 140-3; the third cassette 140-3 is misplaced (due to an error) in a slot dedicated to the first cassette 140-1; and the second cassette 140-2 is placed in its correct slot. Also, assume that the first cassette 140-1 is correctly loaded with 10 USD denomination 142-1; the second cassette 140-2 is correctly loaded with 20 USD denomination 142-2; and the third cassette 140-3 is correctly loaded with 50 USD denomination 142-3. Thus, the first signal command which was meant for the first cassette 140-1 to dispense one 10 USD bill (corresponding to the first expected number of bills) goes to the third cassette 140-3; and the second signal command to dispense five 20 USD bills (corresponding to the second expected number of bills) goes to the second cassette 140-2. Therefore, the third cassette 140-3 dispenses one 50 USD bill; and the second cassette 140-2 dispenses five 20 USD bills. The camera 170 captures the first set of images 132 of the one 50 USD bill dispensed from the third cassette 140-3 and sends them to the image processing engine 122. The image processing engine 122 determines that the currency denomination 142 of the 50 USD bill dispensed from the third cassette 140-3 does not match the first currency denomination 142-1 associated with the first cassette 140-1 (i.e., 10 USD denomination 142-1) using the image recognition algorithm described in FIG. 1. Thus, the processor 120 generates an alert indicating that the first cassette 140-1 is loaded with at least one currency denomination 142 that is not the first currency denomination 142-1 and/or the first cassette 140-1 is misplaced with another cassette 140.

Then, the camera 170 captures the second set of images 132 of the five 20 USD bills and sends them to the image processing engine 122. The image processing engine 122 determines that the currency denomination 142 of the five 20 USD bills dispensed from the second cassette 140-2 matches the second currency denomination 142-2 associated with the second cassette 140-2 (i.e., 20 USD denomination 142-2) using the image recognition algorithm described in FIG. 1. Here, the processor 120 does not generate an alert regarding the second cassette 140-2.

In some embodiments where a cassette 140 is flagged as faulty, the processor 120 may be configured to use another cassette 140 to fulfill the user's request. For example, if the second cassette 140-2 (associated with the 20 USD denomination 142-2) is flagged as faulty, the processor 120 may be configured to calculate a new number of bills form another cassette 140 (e.g., use two 10 USD bills from the first cassette 140-1) to fulfill the user's 150 withdrawal request.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. An automated teller machine (ATM), comprising:

a plurality of cassettes, wherein each cassette is configured to be loaded with a specific currency denomination, comprising:

a first cassette associated with a first currency denomination; and a second cassette associated with a second currency denomination;

a processor operably coupled to the plurality of cassettes, and configured to:

receive a withdrawal request from a user operating a user interface of the ATM to receive cash from a cash dispenser of the ATM;

determine currency denominations and a number of bills for each currency denomination needed to fulfill the withdrawal request, wherein expected cash to be dispensed from the ATM is a sum of multiplications of each currency denomination with the number of bills; and send signal commands to the plurality of cassettes to dispense bills based on the determined currency denominations and the number of bills for each currency denomination to fulfill the withdrawal request; and a camera positioned in a pathway of the bills being dispensed from the plurality of cassettes to the cash dispenser, and configured to:

capture images of bills being dispensed from the plurality of cassettes; and send the images of bills to the processor;

wherein the processor is further configured to:

determine actual dispensed cash from the plurality of cassettes based on received images;

determine whether the actual dispensed cash matches the expected cash to be dispensed from the ATM;

generate an alert if the actual dispensed cash does not match the expected cash;

determine whether the number of bills dispensed from each cassette from the plurality of cassettes matches a corresponding number of bills expected to be dispensed from a corresponding cassette, such that even if the actual dispensed cash matches the expected cash, any discrepancy between the number of bills dispensed from each cassette and the corresponding number of bills expected to be dispensed from the corresponding cassette is determined; and generate a second alert if a number of bills dispensed from at least one cassette does not match a corresponding number of bills expected to be dispensed from the at least one cassette.

2. The automated teller machine of claim 1, wherein:

a first camera is positioned with respect to the first cassette and captures images of bills being dispensed from the first cassette;

a second camera is positioned with respect to the second cassette and captures images of bills being dispensed from the second cassette; and each of the first camera and second camera sends captured images to the processor.

3. The automated teller machine of claim 1, wherein:

the processor is further configured to determine that the first cassette dispenses bills first and the second cassette dispenses bills second;

the camera captures images of the bills dispensed from the first cassette;

the camera sends the images of bills from the first cassette to the processor;

the processor determines whether currency denominations of bills from the first cassette match the first currency denomination;

the processor generates an alert if the currency denominations of any of the bills from the first cassette does not match the first currency denomination;

the camera captures images of the bills dispensed from the second cassette;

the camera sends the images of bills from the second cassette to the processor;

the processor determines whether currency denominations of bills from the second cassette match the second currency denomination; and the processor generates an alert if the currency denominations of any of the bills from the second cassette does not match the second currency denomination.

4. The automated teller machine of claim 1, wherein in response to a determination that the actual dispensed cash does not match the expected cash, the processor is further configured to generate a failed transaction message to be displayed on the user interface.

5. The automated teller machine of claim 1, wherein in response to a determination that the actual dispensed cash does not match the expected cash, the processor is further configured to initiate a service request to a vendor of the ATM.

6. The automated teller machine of claim 1, wherein, in response to a determination that the actual dispensed cash does not match the expected cash, the processor is further configured to:

determine whether the first cassette is dispensing a currency denomination not associated with the first cassette; and in response to a determination that the first cassette is dispensing a currency denomination not associated with the first cassette, flag the first cassette as faulty.

7. The automated teller machine of claim 1, wherein the processor is further configured to in response to a determination that the actual dispensed cash does not match the expected cash:

determine whether the second cassette is placed in a slot not dedicated for the second cassette; and in response to a determination that the second cassette is placed in a slot not dedicated for the second cassette, flag the second cassette as faulty.

8. The automated teller machine of claim 1, wherein the automated teller machine further comprises a memory that stores an image recognition algorithm, and determining the actual dispensed cash from the plurality of cassettes comprises using the image recognition algorithm to determine a currency denomination of each bill by comparing specific characteristics of each bill to specific characteristics of a bill with a known currency denomination, and the actual dispensed cash is a sum of multiplications of each currency denomination determined by the image recognition algorithm with the number of bills for each currency denomination.

9. The automated teller machine of claim 8, wherein the specific characteristics of each bill comprise a bar code, colors, sizes, graphics, texts, and digits representing a denomination of each bill.

10. An automated teller machine (ATM) comprising:

a plurality of cassettes, wherein each cassette is configured to be loaded with a specific currency denomination, comprising:

a first cassette associated with a first currency denomination; and a second cassette associated with a second currency denomination;

a processor operably coupled to the plurality of cassettes, and configured to:

receive a withdrawal request from a user operating a user interface of the ATM to receive cash from a cash dispenser of the ATM;

determine a first expected number of bills from the first cassette;

determine a second expected number of bills from the second cassette;

wherein expected cash to be dispensed from the ATM to fulfill the withdrawal request is a sum of the first expected number of bills from the first cassette multiplied by the first currency denomination and the second expected number of bills from the second cassette multiplied by the second currency denomination; and send signal commands to the first cassette and the second cassette to dispense the first expected number of bills and the second expected number of bills, respectively; and a camera positioned in a pathway of the bills being dispensed from the plurality of cassettes to the cash dispenser, and configured to:

capture images of bills being dispensed from the first cassette and the second cassette; and send the images of the bills to the processor;

wherein the processor is further configured to:

determine a first actual number of bills dispensed from the first cassette and a second actual number of bills dispensed from the second cassette;

determine whether the first actual number of bills matches the first expected number of bills;

in response to a determination that the first actual number of bills does not match the first expected number of bills, generate a first alert indicating that the first cassette is faulty;

determine whether the second actual number of bills matches the second expected number of bills; and in response to a determination that the second actual number of bills does not match the second expected number of bills, generate a second alert indicating that the second cassette is faulty; such that even if a total actual dispensed cash comprising the first actual number of bills and the second actual number of bills matches a total expected number of bills comprising the first expected number of bills and the second expected number of bills, any discrepancy between a number of bills dispensed from each cassette and a corresponding number of bills expected to be dispensed from a corresponding cassette is determined.

11. A method for detecting errors in an automated teller machine (ATM), comprising:

receiving a withdrawal request from a user operating a user interface of the ATM to receive cash from a cash dispenser of the ATM, wherein the ATM comprises a plurality of cassettes, wherein each cassette is configured to be loaded with a specific currency denomination, the plurality of cassettes comprises a first cassette associated with a first currency denomination and a second cassette associated with a second currency denomination;

determining currency denominations and a number of bills for each currency denomination needed to fulfill the withdrawal request, wherein an expected cash to be dispensed from the ATM is a sum of multiplications of each currency denomination with the number of bills;

sending signal commands to the plurality of cassettes to dispense bills based on the determined currency denominations and the number of bills for each currency denomination to fulfill the withdrawal request;

capturing images of bills being dispensed from the first cassette and the second cassette by a camera positioned in a pathway of the bills being dispensed from the plurality of cassettes to the cash dispenser;

sending the images of bills to a processor by the camera;

determining an actual dispensed cash from the plurality of cassettes based on received images;

determining whether the actual dispensed cash matches the expected cash to be dispensed from the ATM;

generating an alert if the actual dispensed cash does not match the expected cash;

determine whether the number of bills dispensed from each cassette from the plurality of cassettes matches a corresponding number of bills expected to be dispensed from a corresponding cassette, such that even if the actual dispensed cash matches the expected cash, any discrepancy between the number of bills dispensed from each cassette and the corresponding number of bills expected to be dispensed from the corresponding cassette is determined; and generate a second alert if a number of bills dispensed from at least one cassette does not match a corresponding number of bills expected to be dispensed from the at least one cassette.

12. The method of claim 11, wherein:

a first camera is positioned with respect to the first cassette and captures images of bills being dispensed from the first cassette;

a second camera is positioned with respect to the second cassette and captures images of bills being dispensed from the second cassette; and each of the first camera and second camera sends captured images to the processor.

13. The method of claim 11, wherein the method further comprises:

determining that the first cassette dispenses bills first and the second cassette dispenses bills second;

capturing images of the bills dispensed from the first cassette by the camera;

sending the images of bills from the first cassette to the processor by the camera;

determining whether currency denominations of bills from the first cassette match the first currency denomination;

generating an alert if the currency denominations of any of the bills from the first cassette does not match the first currency denomination;

capturing images of the bills dispensed from the second cassette by the camera;

sending the images of bills from the second cassette to the processor by the camera;

determining whether currency denominations of bills from the second cassette match the second currency denomination; and generating an alert if the currency denominations of any of the bills from the second cassette does not match the second currency denomination.

14. The method of claim 11, wherein in response to a determination that the actual dispensed cash does not match the expected cash, the method further comprising:

generating a failed transaction message to be displayed on the user interface.

15. The method of claim 11, wherein in response to a determination that the actual dispensed cash does not match the expected cash, the method further comprising:

initiating a service request to a vendor of the ATM.

16. The method of claim 11, wherein in response to a determination that the actual dispensed cash does not match the expected cash, the method further comprising:

determining whether the first cassette is dispensing a currency denomination not associated with the first cassette; and flagging the first cassette as faulty in response to a determination that the first cassette is dispensing a currency denomination not associated with the first cassette.

17. The method of claim 11, wherein in response to a determination that the actual dispensed cash does not match the expected cash, the method further comprising:

determining whether the second cassette is placed in a slot not dedicated for the second cassette; and flagging the second cassette as faulty in response to determining that the second cassette is placed in a slot not dedicated for the second cassette.

18. The method of claim 11, wherein the method further comprising:

determining the actual dispensed cash from the plurality of cassettes comprises using an image recognition algorithm to determine a currency denomination of each bill by comparing specific characteristics of each bill to specific characteristics of a bill with a known currency denomination, wherein the actual dispensed cash is a sum of multiplications of each currency denomination determined by the image recognition algorithm with the number of bills for each currency denomination.

19. The method of claim 18, wherein the specific characteristics of each bill comprise a bar code, colors, sizes, graphics, texts, and digits representing a denomination of each bill.

20. The method of claim 11, further comprising in response determining that the actual dispensed cash does not match the expected cash, calculating a new number of bills for each currency denomination to fulfill the withdrawal request.

* * * * *